United States Patent [19]

Cater

[11] 4,274,560

[45] Jun. 23, 1981

[54] ATOMIZING PUMP DISPENSER

[75] Inventor: Miro S. Cater, Newtown, Conn.

[73] Assignee: Emson Research Incorporated, Bridgeport, Conn.

[21] Appl. No.: 765,701

[22] Filed: Feb. 8, 1977

Related U.S. Application Data

[63] Continuation-in-part of Ser. No. 682,059, Apr. 30, 1976, abandoned.

[51] Int. Cl.[3] ..... B05B 9/043

[52] U.S. Cl. ..... 222/321; 222/383; 277/205

[58] Field of Search ..... 222/321, 380; 277/152, 277/205; 239/333, 329, 331

[56] References Cited

U.S. PATENT DOCUMENTS

| | | | |
|---|---|---|---|
| 2,004,295 | 6/1935 | Rothchild et a. | 222/321 |
| 2,631,906 | 3/1953 | Brock | 277/152 |
| 2,657,834 | 11/1953 | Bacheller | 222/321 |
| 3,211,346 | 10/1965 | Meshberg | 222/321 |
| 3,331,559 | 7/1967 | Fedit | 222/321 X |
| 3,399,836 | 9/1968 | Pechstein | 222/321 X |
| 4,022,354 | 5/1977 | Kotuby | 222/321 |
| 4,025,046 | 5/1977 | Boris | 222/321 X |
| 4,051,983 | 10/1977 | Anderson | 222/321 |
| 4,061,247 | 12/1977 | Meshberg | 222/321 X |
| 4,089,442 | 5/1978 | Hafele et al. | 222/321 |
| 4,144,987 | 3/1979 | Kishi | 222/321 |

FOREIGN PATENT DOCUMENTS

| | | | |
|---|---|---|---|
| 2285815 | 4/1975 | France | 222/321 |
| 2249716 | 5/1975 | France | 222/321 |
| 2305241 | 10/1976 | France | 222/321 |

*Primary Examiner*—Robert J. Spar
*Assistant Examiner*—Frederick R. Handren
*Attorney, Agent, or Firm*—Kenyon & Kenyon

[57] ABSTRACT

A pump which will atomize a liquid without dribble is formed of a pump body having a pump chamber with a throat at the bottom thereof; a pump stem and piston assembly disposed in the chamber for reciprocal motion therein, an axial bore being formed through the bottom of said piston and stem terminating in an axial outlet port; a valve member having a top section sealing against said axial port and a bottom section passing through and sealing said throat after the initial operation when said pump is operated; and a spring biasing said valve member upward. The sealing area at the axial port is selected so as to be less than the sealing area at the throat at the bottom of the chamber whereby when a predetermined pressure is reached within the pump chamber the net force exerted on the valve member acts against the spring to open the axial port to the stem causing material to be dispensed at the predetermined pressure without dribbling.

25 Claims, 6 Drawing Figures

ATOMIZING PUMP DISPENSER

RELATED APPLICATIONS

This application is a continuation-in-part of application Ser. No. 682,059 filed Apr. 30, 1976, now abandoned.

BACKGROUND OF THE INVENTION

This invention relates to dispensers in general and more particularly to an improved pump type dispenser which permits dispensing without dribbling.

In the prior art aerosol containers have been used almost exclusively where a fine mist is to be dispensed such as when dispensing perfumes, deodorants, and the like. The recent concern about the pollution of the upper atmosphere by the propellants used in such aerosol containers such as Fluorocarbons and the possibility of legislation prohitibing such propellants has led to the need for improved pump type dispensers which can give performance equivalent to that of of an aerosol.

Small pumps have been used to dispense various materials. A pump exhibiting excellent properties with regard to ease of construction and good sealing to avoid spillage while still having good venting is that disclosed in copending U.S. Application Ser. No. 633,799 now U.S. Pat. No. 4,113,145.

However, a common problem with this and other prior art pumps is that a good dispensing of a fine mist will only take place if the operator pushes down the actuator with the proper force and speed. Otherwise, what is known as dribble occurs, the liquid dribbling out of the outlet instead of coming out in a fine mist. It has been recognized that a solution to this problem lies in preloading the dispenser. Various means have been developed for carrying out such preloading, some of which are described in the aforementioned application. Another example of to preloading device is disclosed in U.S. Pat. No. Re. 28,366 reissued to F. Pechstein on Mar. 18, 1975 based on an original patent issued Nov. 21, 1966. Pechstein's device includes a pump body which has a first, upper variable volume space or cylinder and a lower, second variable volume space. A piston is attached to a stem having an outlet passage which attaches to the actuator nozzle, the piston being disposed within the upper cylinder. A second piston is disposed within the lower cylinder and is biased upward by a spring. Associated with this second piston is a valve. Shown is a ball check valve and a collar valve in two separate embodiments. The stem to which the first piston is attached has a bore formed axially therethrough with the inside end of the bore, which is located within the upper cylinder chamber, closed by a valve. The valve is attached to the second piston in a manner such that there is the possibility of relative motion between the valve and the second piston. In the illustrated embodiment this is accomplished through the use of fingers on a shaft extending from the second piston and riding in slots formed in a depending portion of the valve member. In operation, as explained in the patent, pressing down on the actuator causes downward movement of the second piston compressing the spring which is biasing it upward. The piston moves downward with the fingers riding in the slots until a certain predetermined precompression is obtained whereupon the valve to the outlet passage in the stem is opened by further movement of the second piston permitting material to be dispensed therethrough and out of the nozzle actuator.

As can be seen from the above description, the pump comprises a relatively large number of parts. These include the pump housing, the stem and first piston, the valve at the inlet to the axial outlet bore in the stem, the connecting member between the second piston with its fingers, the ball check valve, the second piston and the spring. In the one embodiment utilizing a resilient collar, the number of parts is reduced since it is possible to make the second piston, valve and connecting means of the single part. However, the difficulty in inserting this connecting member into the valve so that the the pins are free to slide in slots therein, possibly requiring a separate pin press fitted into the connecting member, is evident. In pumps of this nature which are to be used with throw-away dispensers the cost of making the pump is significant. Even a difference in cost only amounting to pennies can make the difference between a successful and unsuccessful product. Thus, the large number of parts in this device is problematic, particularly because of the increased cost of assembly which would be involved.

Another pump of somewhat similar construction is known. In this pump upper and lower pistons are used as in the above patent. Once again a valve is used for closing off an axial passage or bore through the stem which is connected to the upper passage. A lower piston which is closed off by a ball check valve is utilized with a connecting member extending therefrom and rigidly connected to the valve at the bottom of the axial passage. This pump includes a spring, a body member, an upper piston and stem assembly, a valve and connecting member assembly, and the lower piston assembly, which snaps into the valve and connecting member assembly after a ball check valve is placed in a suitable recess therein. Thus, this valve too, although presently being produced and used, requires additional assembly steps over conventional pumps.

In view of the above discussion the need for an improved pump which fulfills the purpose of prepressurization to permit dispensing a material in a fine mist regardless of how quickly the user presses the actuator button, which pump can be made in a inexpensive and simple manner with a minimum number of parts becomes evident.

SUMMARY OF THE INVENTION

The present invention provides a solution to this problem. It accomplishes prepressurization with the minimum number of parts. Other than the spring used in the pump for maintaining the valve coupled to the axial passage in a closed position when the pump is unoperated, and which is also used in determining the amount of prepressurization which takes place, the pump comprises only three parts all of which can be molded of plastic and which can be easily assembled. It starts with a basic construction similar to the pumps of the aforementioned copending application. The first part is a pump body having an upper cylindrical chamber and a lower chamber which is not in the form of a variable volume chanber as in the prior art pumps. The second member is an upper piston and stem assembly similar to those disclosed in the aforementioned patent and commercial device. The third part is a combination upper and lower valve which functions to both seal off the the axial outlet passage to the actuator until proper prepressurization is reached and also acts, when the pump is operated, to close off the bottom of the pump chamber. This member comprises a lower cylindrical portion and an upper cylindrical portion terminating in a valve member which closes off an axial bore connecting the axial passageway of the stem with the pump chamber. This forms the valve for the pump. The lower cylindrical portion of the member has, near its bottom, at least one inlet means which, when the pump is in its unoperated position, permits the liquid being dispensed to fill the pump chamber. At the bottom of the pump chamber is a throat portion which comes in frictional contact with the lower cylindrical portion of the member. Downward motion of the piston and stem, which carries with it the member containing the lower cylindrical member, causes the inlet means to move below the throat thereby closing off the inlet to the pump chamber. The third member is acted upon by the spring which biases it to close the outlet valve. An essential feature of the third member is that it has an area upon which the pressure in the pump chamber can act in a downward direction against the spring greater than any area in the chamber on which pressure can act in an upward direction to result in a net downward force against the spring. Such will occur as long as the area of the axial outlet in the stem is smaller than the throat at the chamber bottom. This pump employs the principles of the pumps disclosed and claimed in U.S. application Ser. No. 633,799 filed Nov. 20, 1975, now U.S. Pat. No. 4,113,145, particularly with regard to the sealing at the bottom of the pump chamber and in venting of the pump.

In operation, the stem is pressed down by the actuator causing the piston to move downward. The valve member attached to the upper cylindrical portion of the third member is held in engagement with the axial bore in the stem by the spring and the third member also moves downward. Thus, the inlet at the bottom of the lower cylindrical member is closed off. Pressure then begins to build up. This pressure acts on the third member to reasult in a net downward force acting against the force of the spring. When the pressure reaches the point where this force is greater than the spring force, the third member with the valve member on its upper cylindrical portion moves downward under the force of the pressure opening the valve to permit the fluid being dispensed to flow out the passageway and the actuator. Such happens when sufficient pressure is present within the pump chamber so as to dispense the material as a mist and to prevent any dribble. The pressure at which this occurs can be selected by selecting the ratio of the two areas mentioned above.

A particularly important embodiment of the present invention which utilizes a flexible seal as the throat at the bottom of the pump chamber is also shown. This flexible seal improves sealing and, because of its wiping action, permits dispensing liquids containing granular material such as antiperspirants. Also shown in connection with this embodiment are means to improve the guiding of the pump stem and piston as the pump is actuated to give a smoother and easier operation.

Also illustrated is an embodiment of the present invention in the form of a trigger pump.

DETAILED DESCRIPTION OF THE PREFERRED EMBODIMENT

Figure 1:
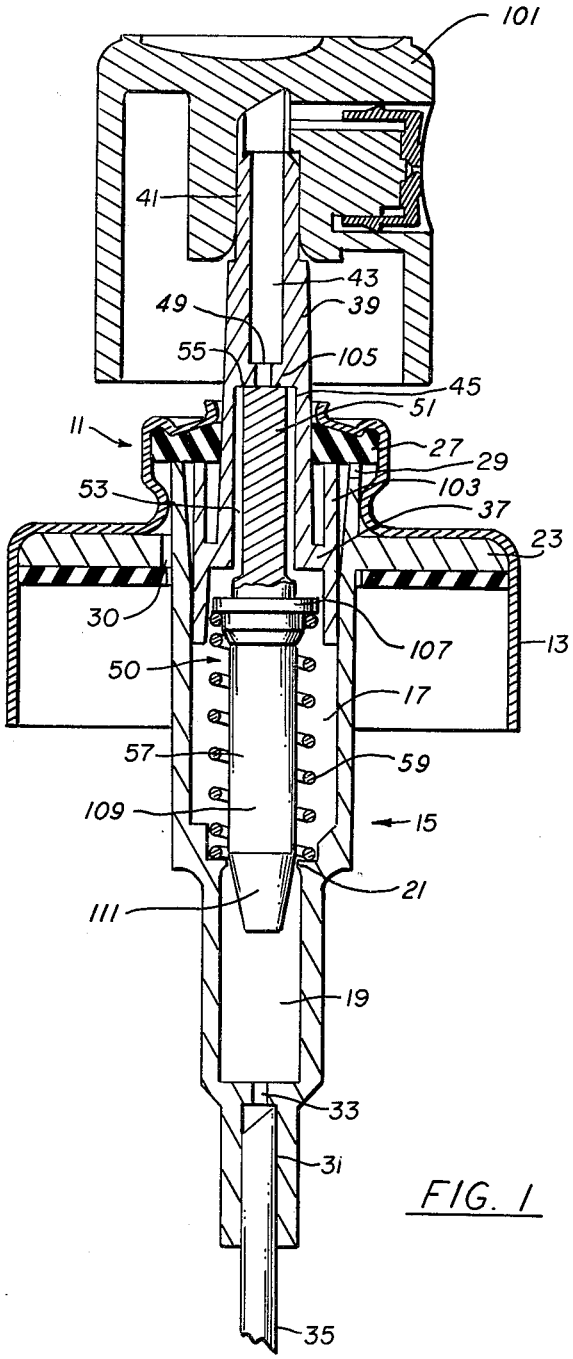
FIG. 1 is a cross-sectional view of a first embodiment of a pump according to the present invention.

FIG. 1 illustrated a first embodiment of the present invention. Shown is a pump generally designated as 11 installed within a mounting cup 13 which mounting cup can then be attached to a can or bottle containing the material to be dispensed. The pump includes a pump body 15 having an upper section of a first diameter forming a first chamber 17 i.e., the pump chamber and a lower portion forming a second chamber 19. At the junction of the chambers 17 and 19 a throat 21 is formed. The upper portion of the body 15 contains an annular flange 23. The flange 23 snaps into the mounting cup 13 which is provided with detents 25 for the purpose. In the upper portion of the mounting cup is a disc 27 which can be of rubber or other flexible material. When snapped into place, the upper portion of the body 15 abuts against this disc 27. A plurality of notches and passageways 29 are formed at the top of the body 15 to provide venting of the type disclosed in the aforementioned U.S. Application Ser. No. 633,799. Below the chamber 19 is a narrow section 31 of hollow cylindrical shape coupled to the chamber 19 through an axial bore 33. This cylindrical portion is adapted to accept a dip tube 35 which will extend to the bottom of the container to which the pump is attached.

Within the upper chamber 17 is disposed a piston 37 which is on the end of a projecting stem 39. The stem 39 has an upper cylindrical portion 41 adapted to accept an actuator and nozzle mechanism 101 of conventional design. An axial bore 43 is formed in the upper portion of the stem 39. A second axial bore 45 is formed in the lower portion of the stem starting within the confines of the piston 37. An axial port or passageway 49 connects these two bores. Disposed within the bore 45 is a valve member 50 which includes a cylindrical member 51 containing ribs 53. The cylindrical member 51 terminates in an annular sealing edge 55, forming with the bore 49, an outlet valve for the pump. On the bottom of the member 51 molded intregally therewith is a cylindrical portion 57. The cylindrical portion 57 is of a greater diameter than the portion 51 with the ribs 53. Between portions 51 and 57 is a flange 107. Between the bottom of chamber 17 and flange 107 is a spring 59 biasing the valve member 50 upward pushing annular edge 55 of the member 51 into sealing contact with the area below port 49 thereby sealing the port 49 and pushing the stem 39 and piston 37 upward.

The stem 39 has a diameter such that there is a friction tight fit between it and the sealing disc 27 at the top of the mounting cup. This, along with flange 103 of piston 37 pushing disk 27 upward in contact with mounting cup 13, prevents leakage of the material from the pump and container when unoperated. The stem 39 is tapered for venting purposes. Its operation will be described in more detail below. The cylindrical portion 57 of valve member 50 has a tapered portion 111 near its bottom. In the position shown, the pump is unoperated. In this position a passage exists from inside the container through the dip tube, through chamber 19 and around the tapered section to pump chamber 17.

When operated, an actuator 101 placed on the stem portion 41 is pressed downward causing the piston 37 to move downward and with it the valve member 50. After the member 57 moves a short distance, the throat 21 acts in cooperation with the cylindrical portion 57 to close off the bottom of the chamber 17. As the user continues to press on the actuator, pressure is built up inside the chamber 17. This pressure acts on the surfaces of the valve member 50 resulting in a net force against the force of the spring 59. When the pressure times the difference between the area of throat 21 and the area within sealing edge 55 is equal to the force of the spring 59, the valve member 50 moves downward moving the sealing edge 55 of the valve away from the bore 49 and permitting material to be dispensed through the port 49 and bore 43 to the actuator 101. This occurs only after sufficient pressure has built up within the chamber 17 to insure proper dispensing as a mist and to prevent any possibility of dribble. This pressure is controlled by the difference between the two areas mentioned above the force of spring 59.

As the stem 39 is pushed downward, the tapered stem will permit air to flow therearound and through the passage 29 and suitable holes 30 in flange 23 down into the container to equalize the air pressure therein. Thereafter, as the pump finishes its dispensing stroke and the stem is allowed to move upward, as soon as the tapered section 111 is uncovered, the partial vacuum which has been created within the chamber 17 will draw additional fluid up into that chamber to ready it for the next dispensing stroke.

With the above construction, no matter how the operator moves the actuator and stem 39 downward, dispensing will not take place unless there is sufficient pressure. If at any time pressure drops below that necessary for good dispensing, the valve made up of the sealing edge 55 and the port 49 will close to prevent any dribbling and will then reopen to dispense a spray once sufficient pressure is built up. The particular pressure at which this occurs will be determined by the spring 59 and by the areas of the throat 21 and sealing edge 55. Through proper selection of these parameters a pressure of, for example 7 to 9 pounds can be selected as the pressure at which the valve will open to dispense the material. For example, with a maximum spring force of 3 pounds and assuming 1 pound of friction, with a maximum desired actuation force of 8 pounds, using a member 57 having a diameter of a quarter inch and a sealing edge 55, of 0.180 inches in diameter, the minimum force at the beginning of the stroke will be 4.85 pounds and the maximum force at the end of the stroke 7.76 pounds.

Preferably all parts other than the mounting cup 13 and the disc 27 will be of molded plastic construction. (The disk may be of soft plastic or a rubber type material.) Note that only three parts must be so molded. These include the body 15, the stem and piston assembly 37, 39 and the valve and member 50. Also the simplicity of construction should be noted. Assembly of a pump of this nature can be very easily automated. Note that the parts all fit together in a simple fashion. Once the spring 59 is inserted into the body 15, the valve member 50 can simply be dropped in the body, the stem and piston, 39, 37 simply be placed thereover, the disc 27 placed in the mounting cup and the body with the other parts snapped into place therein. Since in effect all of the parts nest together, the pump lends itself to automated assembly thereby considerably reducing its cost of construction.

Figure 2:
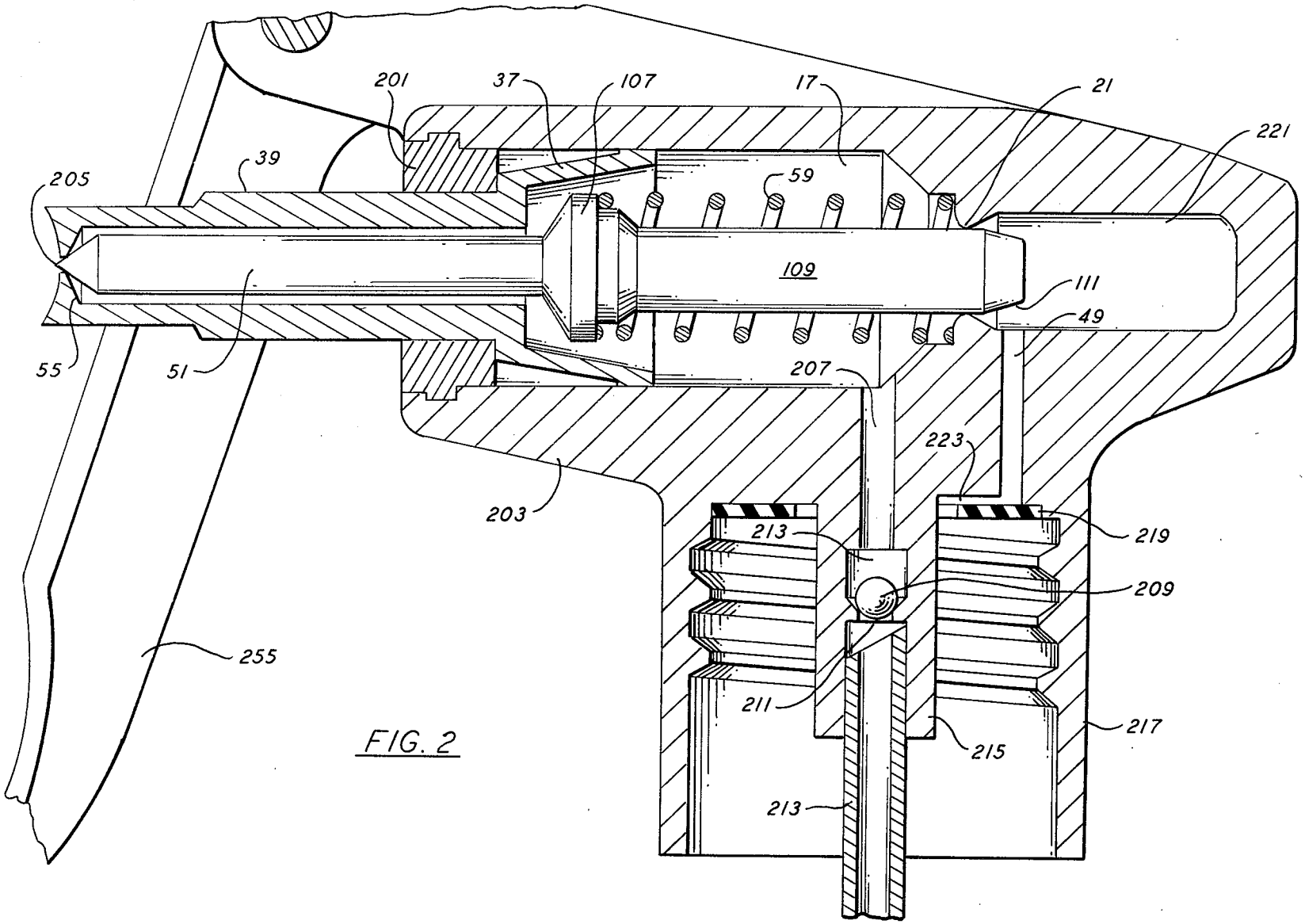
FIG. 2 is a similar view of a second embodiment in the form of a trigger-operated pump.

FIG. 2 illustrates apparatus generally like that of FIG. 1 in a trigger type dispenser which is generally used for dispensing larger quantities of a liquid. The previously disclosed embodiments typically are used to dispense small quantities of deodorant, perfume or something of the like. A trigger type dispenser, on the other hand, is normally used with cleaning solutions and the like where much larger quantities are required. In this embodiment parts which are identical to those of FIG. 1 will be given the same reference numerals. In this embodiment, the upper stem 39 having the piston 37 on its end projects through a sealing member 201 fitted into the end of the gun shaped pump housing 203. Discharge takes place directly from an axial bore 205 formed in the end of the stem piece 39. The upper cylindrical portion 51 which acts as the outlet valve for the device has a conically shaped end 155. It projects through bore 205 and prevents clogging at that point. Portion 51 extends through a bore in cylindrical member 39 all the way to the axial outlet 205. The bottom of this member is constructed much in the manner of the pump of FIG. 1 with a lower cylindrical member 109 having a conical taper 111 on its end disposed below a flanged portion 107. Once again, the spring 59 acts against the flange 107. In this embodiment, because of the large quantities to be dispensed, the pump chamber 17 is coupled through a passageway 207 to a ball check valve formed of a ball resting on a seat at an axial opening 211. The ball is retained within a suitable chamber 213 directly above a dip tube 213 which is press fitted into a suitable bore in a depending portion 215 of the pump housing. It is essentially concentric with a dependent depending flange 217 containing internal threads so that the trigger pump may be screwed on to the top of a container. The inside of this depending flange member is also equipped with a sealing gasket 219 for sealing to the top of the container.

In this embodiment, even in the unoperated position, a seal is formed at the throat 21. Refilling of the pump chamber 17 takes place through the ball check valve 209, 211.

A bore 219 is formed extending from a chamber 221 on the other side of throat 21 from the chamber 17 to the sealing gasket 219. At that point there is an additional radial chamber 223 leading to inside the container on to which the pump is placed. This allows any fluid escaping from pump chamber 17 around throat 21 to be returned to the container.

Venting of the container is not shown but can be accomplished using conventional means. In this type of dispenser, sealing is not as critical as in smaller pumps used with perfume or the like. Thus, a simple bore through the body may be used.

The construction with regard to sealing of the pump chamber 17 and refilling thereof may also take the form shown in FIGS. 1. Such filling would take place through a space such as space 221 with the ball check valve eliminated and the channel 207 coupled to the chamber 221 rather than the chamber 59. In such a case, the channel 219 would be eliminated.

Various modifications of the illustrated structure may be made, particularly with respect to the valve member 50. The top seal of member 51 of FIG. 1 may be conical seal as in FIG. 2. The bottom member 57 may use a ribbed structure or axial bore and radial port as do various embodiments of the aforementioned U.S. application. Similarly, any of the venting means used therein may also be used with the pump of the present invention.

Figure 3:
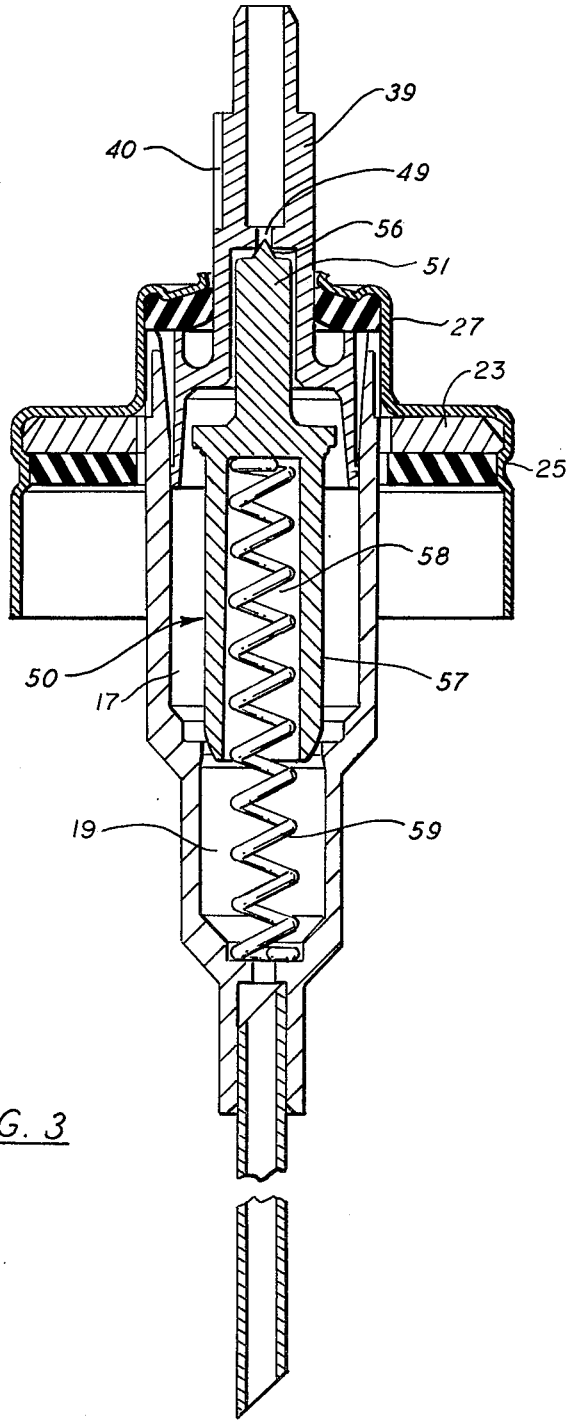
FIG. 3 is a cross-sectional view of a pump similar to that of FIG. 1 with a modified spring arrangement.

One possible modification which is thought to be beneficial is that shown on FIG. 3. Construction is essentially the same as in FIG. 1 except that the cylindrical portion 57 of valve member 50 contains a hollow recess 58 and spring 59 extends from the bottom of chamber 17 and is disposed in the recess 58. In addition, a conical sealing tip 56 on the end of cylindrical portion 51 cooperates with port 49 to form the outlet valve. Also in this embodiment a channel 40 is formed in stem 39, its bottom above the disc 27 when the pump is unoperated. When operated the channel bridges disc 27 to vent the pump.

Figure 4:
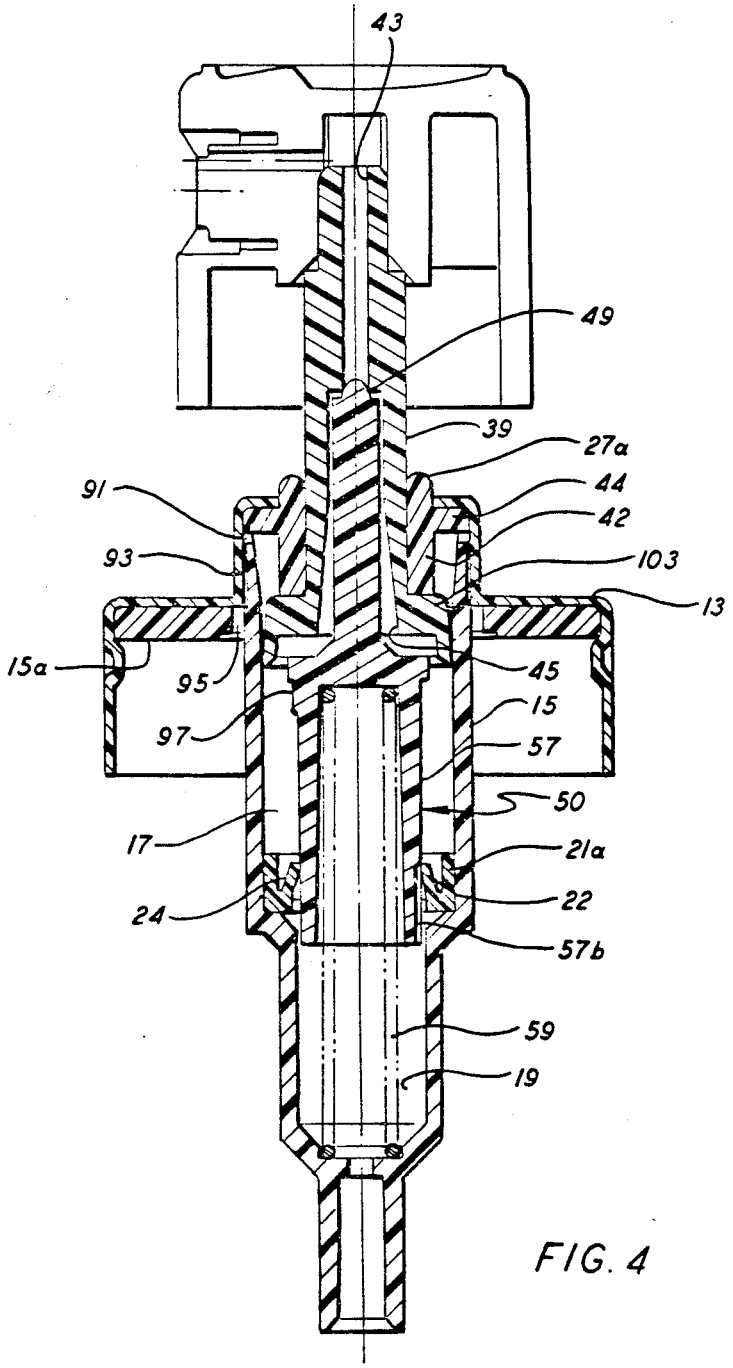
FIG. 4 is a cross-sectional view of a pump similar to that of FIG. 3 utilizing a flexible seal at the bottom of the pump chamber.
Figure 5:
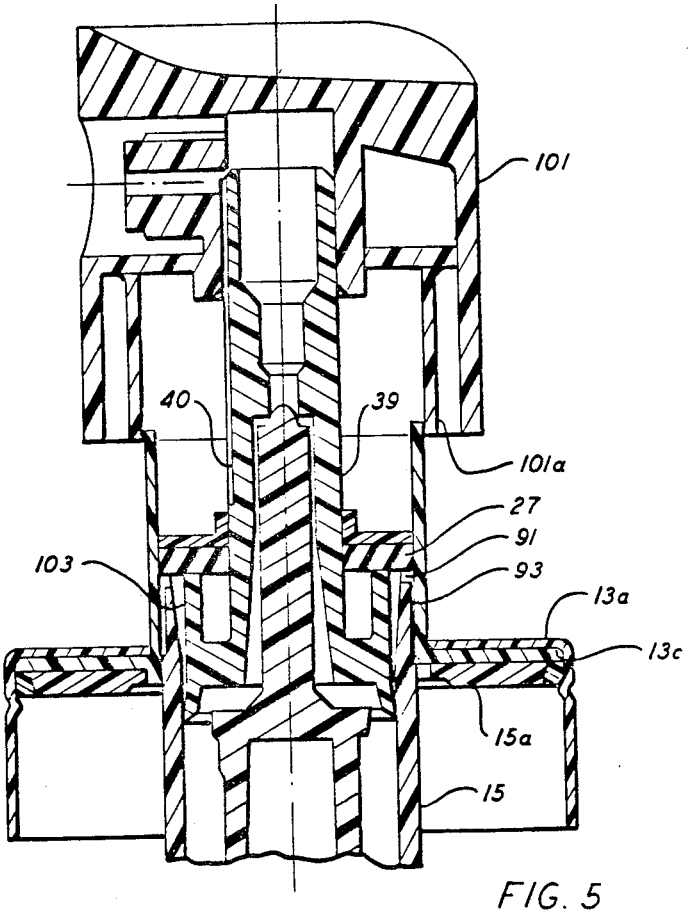
FIG. 5 is a partial view of an emboidment using the flexible seal and also having a mounting cup made partailly of plastic.

FIGS. 4 and 5 illustrated additional embodiments of the present invention which provide for improved sealing at the bottom of the pump chamber. Portions which are essentially identical to those described above in connection with FIGS. 1 and 3 will not be described in great detail. In addition, the same reference numbers will be used where applicable. As in the previous embodiments, there is a pump body 15 having a first chamber 17 and a second chamber 19. However, in this embodiment instead of having a throat 21 as in the embodiments of FIGS. 1 and 3, in the embodiment of FIG. 4 a separate annular seal insert 21*a* is used to cooperate with the lower cylindrical portion 57 to close off the chamber 17 from the chamber 19 when the pump is operated. The stem 39 and the remainder of the valve member 50 are constructed in the same manner described in connection with FIG. 3.

The seal 21*a* can be made of any soft material and, during assembly can be assembled onto the lower cylindrical portion 57 to move it into place. The lower cylindrical portion 57 contains at least one groove 57*b* bridging the contacting edge 22 of the insert 21*a*. This edge 22 is on an annular flexible arm 24 attached to the main body of the flexible sealing ring 21*a*. In the upper portion of the pump, sealing about the stem 39 is obtained by means of a plastic insert 27*a* which is inserted into an opening in the mounting cup 13. This member is shaped with a collar portion 42 with a flange 44 extending therefrom. The upper portion extends through the opening in the mounting cup 13 with the flange 44 acting as a stop. The lower portion of the collar acts as a stop for the upper portion of the piston 103 on the end of the stem 39.

If necessary, a rubber seal may be disposed between the bottom of collar portion 42 and the top of the piston 103. A raised area 97 on cylindrical portion 57 is provided to break the seal at sealing ring 21*a* to aid in priming. This embodiment offers a number of important advantages over an embodiment such as that of FIG. 3. The use of the flexible seal 21*a* permits making the seal of a material such as low density polyethylene which is reasonably soft, while at the same time making the tank of a harder material such as polypropylene. In addition, the wiping action of the seal permits products such as antiperspirants containing granular material, to be dispensed. Such materials tend to clog other types of pumps, particularly pumps utilizing ball check valves. With respect to the seal 21*a* it should further be noted that as the pump is operated, the pressure on the arms 24 thereof tend to push it against the lower portion 57 of the valve member 50 to obtain a better sealing action.

A modification of the embodiment of FIG. 4 is illustrated on FIG. 5. In this embodiment, the lower portion of the pump body and the valve member 50 are exactly as described in connection with FIG. 4 and thus are not shown again. In this embodiment, a different type of mounting cup and sealing arrangement is used. A metal mounting cup part 13*a* e.g. an aluminum part which has a flat top with an opening 13*b* therein has snapped into it a plastic portion 13*c* comprising a cylindrical member with a flange having a downwardly depending portion at its outer edge at its bottom. The pump body 15 is constructed with a flange 15*a* which snaps into the plastic part 13*c* of the mounting cup and is retained by the downwardly depending portion. The shape of metal part 13*a* is much easier to produce than that of the mounting cup of FIG. 3 or 4. The plastic part 13*c* is also an easy form to produce. In this embodiment, a sealing disc 27 of rubber or other pliable material is used as in the embodiment of FIG. 3. As in that embodiment, an upper flange on the piston 103 seals against the sealing disc 27. Since the upper portion of the plastic part 13*c* of the mounting cup does not have as large a guide surface as does the collar 42 in the embodiment of FIG. 4, an annular depending flange 101*a* is formed in the actuator 101 and cooperates with the sides of the plastic part 13*c* to better guide the pump during operation. Both embodiments utilize the type of sealing and venting used in the aforementioned copending application Ser. No. 633,799. That is to say that in both cases a seal is made around the stem 39 and the piston seals to and holds the sealing member 27 and 27*a* against the mounting cup. For purposes of venting, the stem 39 of FIG. 5 has a notch 40 which is above the bottom of the sealing means 27 and 27*a* when the pump is not operated. When the pump is depressed, in order to vent the container, this notch 40 bridges the sealing means 27 or 27*a*. In the embodiment of FIG. 4, the stem 39 is tapered so as to open a gap as it is depressed. The pump body 15 has notches 91 in the top thereof which communicate with grooves 93 in the side of the body which is surrounded by the mounting cup 13. Openings 95 are formed in flange 15*a* to permit communication with the inside of the container.

Although the pump of the present invention has been shown in the type of mounting cup which is crimped about a container, it will be recognized by those skilled in the art that it is equally useable where mounting is by means of a screw-on cap.

Figure 4A:
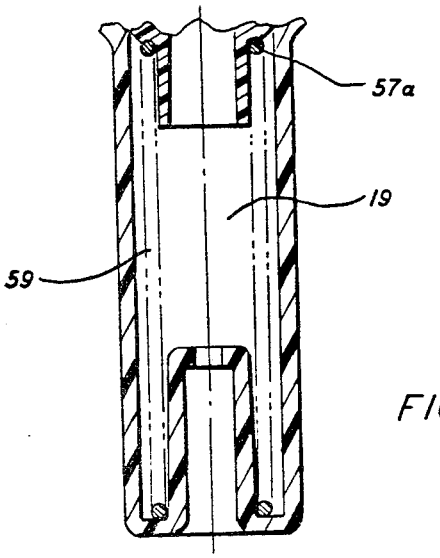
FIG. 4*a* is a cross-sectional view of the bottom portion of a pump similar to that of FIG. 4 showing an alternate manner of spring biasing the valve member.

Another modification is shown on FIG. 4*a*. In this embodiment, the spring 59 extends from the bottom of the chamber 19 to an annular area 57*a* formed on the cylindrical portion 57.

At present it is thought that the most useful embodiment of the pump is that illustrated in FIG. 4 but with a seal 27 and piston 103 such as shown on FIGS. 1 and 3.

What is claimed is:

1. An improved pump for use with a container of liquid material for dispensing and atomizing the liquid material without dribble comprising:

(a) means defining a pump chamber of substantially fixed volume having an inlet, said pump chamber having an opening at its inner end;

(b) valving means disposed at said inlet for preventing a back flow from said pump chamber;

(c) a pump stem having a piston on the end thereof disposed for reciprocal motion in said pump chamber;

(d) said pump stem having a passageway therethrough with a dispensing outlet at the outer end of said passageway and an axial inlet port located inwardly thereof;

(e) a rigid valve member made of plastic having a first end portion cooperating with said axial inlet port to close off said port and a second end portion of a predetermined crosssectional sealing area the axial length of said second end portion of predetermined cross-sectional area being at least equal to the range of movement of said pump stem over which dispensing occurs;

(f) an annular flexible plastic seal having a sealing point disposed above the inner end of said pump chamber said annular seal extending at an angle to the axis through the pump chamber, axially outward from the bottom of said chamber and radially inwardly from the wall of said chamber, whereby radial flexing outward of said seal is possible, forming a fixed throat at the inner end of said chamber for guiding said second end portion, said second end portion cooperating with said throat to form means sealing the bottom of said pump with a surface to surface seal at said throat as said pump is operated by depressing said pump stem to prevent any flow from said pump chamber through said throat when said pump is dispensing;

(g) means for supplying liquid in a container to said valving means;

(h) means biasing said valve member outwardly so that the first end portion thereof closes off said inlet port, and thereby also biasing said pump stem outwardly; and (i) the cross-sectional area closed off at said inlet port being smaller than the cross-sectional area of said second end portion of said valve member at the point where it is sealingly guided, whereby, as said pump is operated by pressing said pump stem, the pressure in the pump chamber is increased until, at a predetermined pressure, said biasing is overcome and said valve member is moved away from said pump stem to open said inlet port and permit pressurized material to be discharged through said passageway and dispensing outlet.

2. Apparatus according to claim 1 and further including a further chamber inward of said pump chamber having as an opening at its outer end the opening at the inner end of said pump chamber and adapted to attach a dip tube at the inner end thereof to place said dip tube in communication with said throat, and wherein said valving means comprise means formed at the end of said second end portion to permit communication from said second chamber through said throat and into said pump chamber when said means biasing are maintaining said stem in a fully outward position.

3. Apparatus according to claim 2 wherein the second end portion of said valve member contains a hollow recess and wherein said biasing means comprise a spring disposed within the hollow recess of said second end portion extending to the inner end of said further chamber.

4. Apparatus according to claim 1, and further including detents formed on the inside of said pump body to retain said annular member in place.

5. Apparatus according to claim 1 wherein said first end portion terminates in a cone.

6. Apparatus according to claim 5 and further including an additional portion on said stem extending outwardly of said axial inlet port said additional portion having a bore formed therethrough; and actuator and atomizing means disposed on the end of said additional portion.

7. Apparatus according to claim 1 further including means for venting said pump.

8. Apparatus according to claim 7 and further including:

(a) an annular flange on the outward portion of said means defining a pump chamber;

(b) a mounting cup containing at least two detent portions said flange being retained in said mounting cup by said detent portions.

9. Apparatus according to claim 8 and further including annular sealing means in said mounting cup, said sealing means frictionally engaging said stem when said stem is in an unoperated position, with said valving means permitting communication into said pump chamber, to thereby prevent spillage of the liquid stored therein.

10. Apparatus according to claim 9 wherein said means for venting comprise:

(a) means on said stem for bridging said annular sealing means when said stem is depressed; and (b) a passage through said means defining a pump chamber from said piston to the inside of a container to which said mounting cup is attached.

11. Apparatus according to claim 10 wherein said means on said stem comprise a taper on said stem to thereby open a gap between said sealing means and said stem when said stem is depressed.

12. Apparatus according to claim 10 wherein said means on said stem comprise a channel formed in the side of said stem having its inner end disposed above said annular sealing means when said pump is unoperated and bridging said annular sealing means when said pump is operated.

13. Apparatus according to claim 9, wherein said mounting cup comprises a metal part comprising a top having a central opening therein and a cylindrical depending flange extending downward therefrom for use in crimping about a container; and a plastic part comprising a cylindrical member having at the bottom thereof an outwardly extending flange with an outside diameter approximately equal to the inside diameter of the depending flange of said mounting cup, a concentric annular member in the upper portion of said cylindrical member for guiding said stem, said plastic part inserted into said metal part, with the cylindrical member thereof extending through said central opening, in said metal part and said pump stem extending through said concentric annular member of said plastic part.

14. Apparatus according to claim 13, and further including an actuator mounted to the end of said stem, said actuator containing thereon a cylindrical downward depending portion concentric with said stem when said actuator is in place, said downwardly depending cylindrical portion cooperating with the cylindrical portion of said plastic part of said mounting cup to act as a guide.

15. Apparatus according to claim 1 and further including an additional portion on said stem extending outwardly of said axial inlet port, said additional portion having a bore formed therethrough; and actuator and atomizing means disposed on the end of said additional portion.

16. Apparatus according to claim 1 wherein said means defining a pump chamber, said pump stem and piston, and said valve member are each of molded plastic construction.

17. Apparatus according to claim 1 wherein said valve member is a one piece member.

18. Apparatus according to claim 1 wherein said annular member is made of a soft material.

19. Apparatus according to claim 18 wherein said annular seal is made of low density polyethylene and said valve member of polypropylene.

20. An improved pump for use with a container of liquid material for dispensing and atomizing the liquid material without dribble comprising:

(a) means defining a pump chamber of substantially fixed volume, said pump chamber having an opening at its inner end and being of essentially constant inner diameter;

(b) an annular flexible plastic seal flexibly inserted at the inner end of said pump chamber having a sealing point disposed above the inner end of said pump chamber, said annular seal extending at an angle to the axis of the pump chamber axially outward from the bottom of said chamber and radially inwardly from the wall of said chamber whereby flexing radially outward of said seal is possible, said annular flexible seal forming a throat at the inner end of said pump chamber;

(c) a pump stem having a piston on the end thereof disposed for reciprocal motion in said pump chamber;

(d) said pump stem having a passageway therethrough with a dispensing outlet at the outer end of said passageway and an axial inlet port located inwardly thereof;

(e) a rigid valve member made of plastic having a first end portion cooperating with said axial inlet port to close off said port and a second end portion of a predetermined cross-sectional sealing area, the axial length of said second end portion of predetermined cross-sectional area being at least equal to the range of movement of said pump stem over which dispensing occurs;

(f) said annular member guiding said second end portion, said second end portion cooperating with said throat to form sealing means at the inner end of said pump chamber with a surface to surface seal at said throat as said pump is operating by depressing said pump stem to prevent any flow from said pump chamber through said throat when said pump is dispensing.

(g) a further chamber inward of said pump chamber having as an opening at its outer end the opening at the inner end of said pump chamber and adapted to attach a dip tube at its inner end to place said dip tube in communication with said throat;

(h) means at the inner end of said second end portion to permit communication from said further chamber through said throat and into said pump chamber when said stem is in a fully outward position;

(i) means biasing said valve member outwardly so that the first end portion thereof closes off said inlet port, and thereby also biasing said pump stem outwardly; and (j) the cross-sectional area closed off at said inlet port being smaller than the cross-sectional area of said second end portion of said valve member at the point where it is sealingly guided, whereby, as said pump is operated by pressing said pump stem, the pressure in the pump chamber is increased until, at a predetermined pressure, said biasing is overcome and said valve member is moved away from said pump stem to open said inlet port and permit pressurized material to be discharged through said passageway and dispensing outlet.

21. Apparatus according to claim 20 wherein said second end portion terminates in a gradually reduced section permitting communication to said pump chamber past said throat when said means biasing are maintaining said stem in a wholly outward position, said cooperating portions of said gradually reduced section and said throat thereby forming said valving means.

22. Apparatus according to claim 20 and further including a raised area near the top of said lower portion of valve member.

23. Apparatus according to claim 20 wherein said seal is made of a material softer than said valve member.

24. An improved pump for use with a container of liquid material for dispensing and atomizing the liquid material without dribble comprising:

(a) means defining a pump chamber of substantially fixed volume having an inlet, said pump chamber having an opening at the inner end thereof and being of essentially constant inner diameter;

(b) valving means disposed at said inlet for preventing a back flow from said pump chamber;

(c) a pump stem having a piston on the end thereof disposed for reciprocal motion in said pump chamber;

(d) said pump stem having a passageway therethrough with a dispensing outlet at the outer end of said passageway and an axial inlet port located inwardly thereof;

(e) a rigid valve member made of plastic having a first end portion cooperating with said axial inlet port to close off said port and a second end portion of a predetermined cross-sectional sealing area, the axial length of said second end portion of predetermined cross-sectional area being at least equal to the range of movement of said pump stem over which dispensing occurs;

(f) a plastic annular member having a flexible sealing surface inserted in said pump chamber at the inner end thereof, forming a throat at said inner end of said chamber for guiding said second end portion, said second portion cooperating with said throat to form means sealing the bottom of said pump chamber with a surface to surface seal at said throat as said pump is operated by depressing said pump stem to prevent any flow from said pump chamber through said throat when said pump is dispensing;

(g) means to retain said annular member in place;

(h) means for supplying liquid in a container to said valving means;

(i) means biasing said valve member outwardly so that the first end portion thereof closes off said inlet port, and thereby also biasing said pump stem outwardly;

(j) means for venting said pump;

(k) an annular flange on the outward portion of said means defining a pump chamber;

(l) a mounting cup containing a least two detent portions, said flange being retained in said mounting cup by said detent portions;

(m) a collar having an annular flange extending from an intermediate point on its side wall so as to form an upper collar portion above said flange and a lower collar portion below said flange, said upper portion inserted through an opening in said mounting cup and said lower portion sealing against the top of said piston, said collar frictionally engaging said stem when said stem in in an unoperated position, with said valving means permitting communication into said pump chamber, to thereby prevent spillage of the liquid stored therein; and (n) the cross-sectional area closed off at said inlet port being smaller than the cross-sectional area of said second end portion of said valve member at the point where it is sealingly guided, whereby, as said pump is operated by pressing said pump stem, the pressure in the pump chamber is increased until, at a predetermined pressure, said biasing is overcome and said valve member is moved away from said pump stem to open said inlet port and permit pressurized material to be discharged through said passageway and dispensing outlet.

25. Apparatus according to claim 24 wherein said means to retain comprise detents formed on the inside of said pump chamber.

* * * * *

UNITED STATES PATENT AND TRADEMARK OFFICE

CERTIFICATE OF CORRECTION

PATENT NO. : 4,274,560

DATED : June 23, 1981

INVENTOR(S) : Miro S. Cater

It is certified that error appears in the above—identified patent and that said Letters Patent is hereby corrected as shown below:

Column 1, line 20, change "prohitibing" to --prohibiting--

Column 1, line 22, after "that" delete --of-- (first occurrence)

Column 1, line 39, change "to" to --a--

Column 2, line 44, change "a" to --an--

Column 2, line 66, after "off" delete --the-- (first occurrence)

Column 3, line 6, before "valve" insert --outlet--

Column 3, line 40, change "reasult" to --result--

Column 4, line 9, change "emboidment" to --embodiment--

Column 4, lines 10-11, change "partailly' to --partially--

Column 4, line 52, change "intregally" to --integrally--

Column 5, line 10, change "21"(small "L") to --21--(the numeral 1)

UNITED STATES PATENT AND TRADEMARK OFFICE

CERTIFICATE OF CORRECTION

PATENT NO. : 4,274,560

DATED : June 23, 1981

INVENTOR(S) : Miro S. Cater

It is certified that error appears in the above—identified patent and that said Letters Patent is hereby corrected as shown below:

Column 6, line 61, change "Figs" to --Fig.--

Column 9, line 11, change "crosssectional" to --cross-sectional--

Column 10, line 30, after "from" insert --outwardly of--

Column 13, line 1, change "a" (second occurrence) to --at--

Signed and Sealed this

*Fourteenth* Day of *September 1982*

[SEAL]

*Attest:*

GERALD J. MOSSINGHOFF

*Attesting Officer*

*Commissioner of Patents and Trademarks*